US006678904B1

(12) United States Patent
Stevens

(10) Patent No.: US 6,678,904 B1
(45) Date of Patent: Jan. 20, 2004

(54) HINGED LINK MATTRESS DECK

(75) Inventor: John Stevens, Carthage, MO (US)

(73) Assignee: L&P Property Management Company, Chicago, IL (US)

( * ) Notice: Subject to any disclaimer, the term of this patent is extended or adjusted under 35 U.S.C. 154(b) by 1,492 days.

(21) Appl. No.: 08/101,573

(22) Filed: Aug. 3, 1993

(51) Int. Cl.[7] ..... A47C 17/22
(52) U.S. Cl. ..... 5/14; 5/13; 5/188
(58) Field of Search ..... 5/659, 186.1, 188, 5/13, 12.1, 14; 297/452

(56) References Cited

U.S. PATENT DOCUMENTS

| | | | | | |
|---|---|---|---|---|---|
| 1,447,294 | A | * | 3/1923 | Cole | 5/188 |
| 2,742,653 | A | * | 4/1956 | Woller | 5/13 |
| 2,851,698 | A | * | 5/1958 | Barabas | 5/13 |
| 3,140,897 | A | * | 7/1964 | Dougherty | 5/659 |
| 3,253,285 | A | | 5/1966 | Fox | |
| 3,380,082 | A | | 4/1968 | Mikos | |
| 3,740,775 | A | | 6/1973 | Metayer | |
| 3,854,153 | A | | 12/1974 | Fadler et al. | |
| 4,476,594 | A | * | 10/1984 | McLeod | 5/659 |
| 4,523,342 | A | * | 6/1985 | Poovey | 5/13 |
| 4,649,583 | A | * | 3/1987 | Krueger | 5/659 |
| 4,815,155 | A | * | 3/1989 | Sommers | 5/659 |
| 4,862,537 | A | * | 9/1989 | Riley | 5/659 |
| 5,231,709 | A | * | 8/1993 | Miller | 5/13 |

FOREIGN PATENT DOCUMENTS

| | | |
|---|---|---|
| BE | 518263 | 2/1955 |

* cited by examiner

*Primary Examiner*—Flemming Saether
(74) *Attorney, Agent, or Firm*—Wood, Herron & Evans, L.L.P.

(57) ABSTRACT

A support deck for a sofa bed having a plurality of support members is interconnected at joints such that when a force is applied to one side of the deck the deck will yield but when a force is applied to the opposite side, the deck will be relatively resilient. The support members consist of molded plastic links which are serially and pivotally interconnected to form the deck from a number of generally parallel longitudinal columns of links. Each link includes a planar upper surface for supporting the mattress and a reinforcing rib on the lower surface for added strength. Pivot pins are used to interconnect the links and a stop is provided on each end of the link to restrict the upward flexing or movement of the joined links. The links are economically and easily manufactured thereby providing a commercially competitive sofa bed without the detrimental aspects associated with prior sofa bed structures.

15 Claims, 4 Drawing Sheets

HINGED LINK MATTRESS DECK

BACKGROUND OF THE INVENTION

This invention relates generally to an apparatus for providing a support deck for a mattress or a seat. The support deck of this invention is particularly suitable for, but not limited to, use in sofa beds. In the past, sofa bed mattress decks have been made with metal link fabrics or polypropylene which are attached to an outside frame with hooks or helical connectors. The link fabric decks have an inherent flaw in that they are comprised of a grid of wires which are free to pivot or yield, thereby offering little resistance when a person sits or rests on the unfolded sofa bed. This yielding effect is known in the bedding industry as "hammocking".

Sofa bed decks which are made from polypropylene likewise suffer from the same inherent flaw in that they consist of a canvas-type material attached to a frame with hooks or helical connectors which are insufficiently resilient to provide proper support for a person sitting, reclining or resting on the sofa bed.

Another problem associated with currently existing decks commonly referred to in the industry as "crowning". Crowning occurs when the sofa bed mattress, after having been folded and recessed back into the sofa, pushes upward against the sofa bed deck to cause a bulge. This crowning effect is particularly a problem with thick mattresses. The bulge is generated because the sofa bed deck is not sufficiently strong enough to resist and contain the folded and compacted mattress.

The bulge created by the crowning of the mattress inhibits the seat cushions from laying flat on the sofa; a condition referred to in the industry as cushion "smiling". Sitting on a sofa with "smiling" cushions is unpleasant in that one teeters back and forth while sitting on the firm mattress bulge.

One proposed solution to these problems has been to manufacture a deck from serially interlocked metallic wire-like link members interconnected by metal rectangular plate-like members such that the resulting deck resists upward force when in a horizontal configuration, but yields to downward force under the weight of one sitting or reclining thereon. Problems associated with this proposed solution include great difficulty in manufacturing the various component parts and, therefore, increased expense in manufacturing a sofa bed or the like with such a deck structure. This is particularly troublesome in the highly competitive bedding and mattress industry in which production and manufacturing costs often distinguish the successful designs from the many comparable alternatives.

SUMMARY OF THE INVENTION

An objective of the this invention is to provide an improved deck structure for use in sofa beds or other seating or bedding support systems.

A further objective is to provide a sofa bed mattress deck that eliminates the problems of "hammocking," "crowning" and cushion "smiling".

A further objective is to provide a sofa bed mattress deck that can accommodate a thicker sofa bed mattress while providing for neat and compact storage or folding of the mattress into the sofa bed.

A further objective is to provide a sofa bed mattress deck that will achieve the above objectives and yet is relatively inexpensive to manufacture.

These objectives are obtained by a support deck attached to a sofa bed frame. The deck is formed from a series of serially hinged links joined together such that when the deck is pushed from the bottom side it resists and maintains its flat surface (i.e. it is in a locked position). However, when the deck is pushed or forced from the top side it yields or bows. As a result, when the sofa bed is unfolded, a firm mattress deck is provided that contours to the user's body without excessive sagging. When folded and stored within the sofa bed, the deck provides a flat surface upon which the sofa bed cushions can be placed without smiling or bulging. In this folded condition, the mattress is pushing upward and outward against the side of the deck that is in a locked position and thereby resists the upward force of the mattress.

The support provided to a person sitting or resting on the sofa bed in the sofa configuration simulates that of a standard sofa with a spring seat. This is due to the fact that the deck, while locked against upward movement, will yield in downward movement in response to a person's weight.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
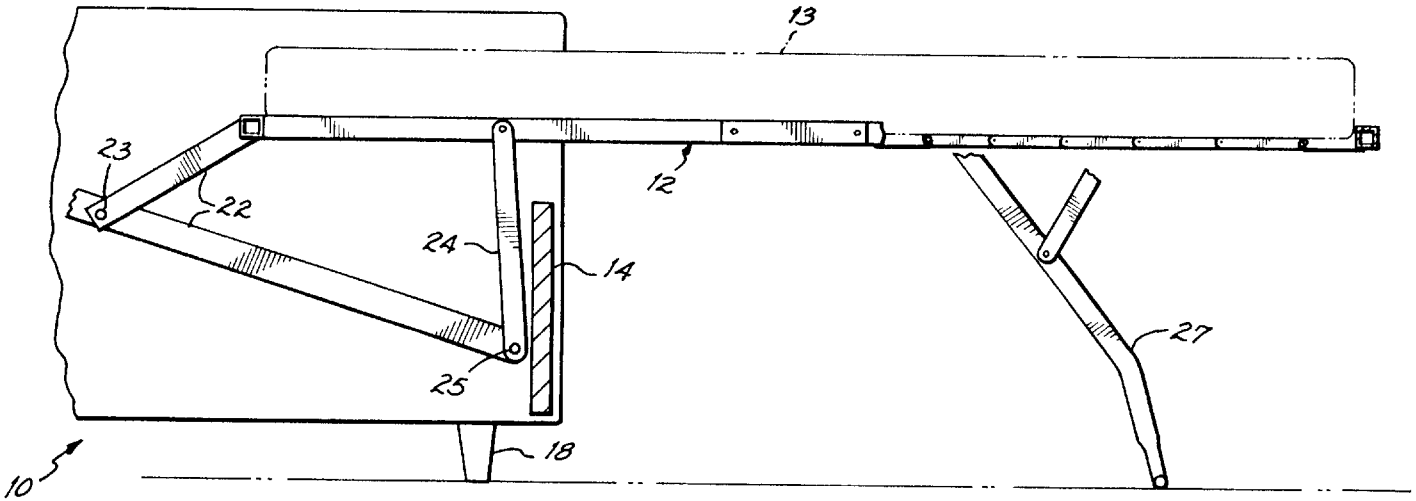
FIG. 1 is a side elevational view of a sofa bed in an open position which incorporates a deck of this invention.
Figure 2:
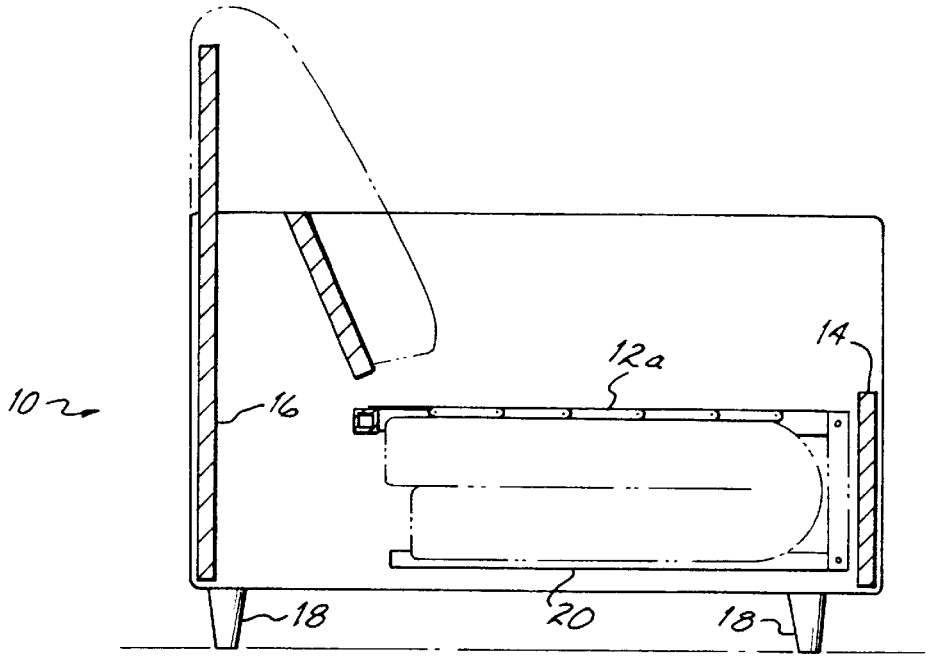
FIG. 2 is a side view of the sofa bed of FIG. 1 in a closed position with portions removed to show internal parts.

Referring to FIG. 1, a sofa bed 10 incorporating a support deck 12 in accordance with this invention for supporting a mattress 13 for movement between a bed position as shown in FIG. 1 and a sofa position as shown in FIG. 2. The sofa bed 10 may has, for illustrative purposes only, a conventional frame structure including a backrest frame 16 upstanding from a base frame 20 supported on the floor by legs 18, and a front rail 14 as shown in FIG. 2. The frame defines a cavity for receiving the sofa bed in the sofa position as shown in FIG. 2 and for allowing the bed to be unfolded from the sofa position into the bed position shown in FIG. 1. It will be appreciated by one of ordinary skill in the art that any conventional sofa bed frame may be utilized in conjunction with the deck of this invention. In addition, the deck may be mounted to the frame by any suitable linkage shown for example by a hinged two bar linkage 22 joined by a pin 23 or other suitable structure and a single bar linkage 24 for movement between the sofa and bed positions. The terminal ends of each linkage 22, 24 are pivotally attached to the frame base 20 as with pivot pin 25 or other suitable mechanisms.

In addition, a conventional leg arrangement such as shown by a foot end leg 27 may be employed to support the deck in the bed position shown in FIG. 1 and yet at the same time to be foldable with the deck into the sofa position shown in FIG. 2.

The mattress 13 itself may also be of any conventional design and configuration. However, the deck of this invention enables the use of mattresses of greater depths with standard sofa beds than have heretofore been possible.

Figure 3:
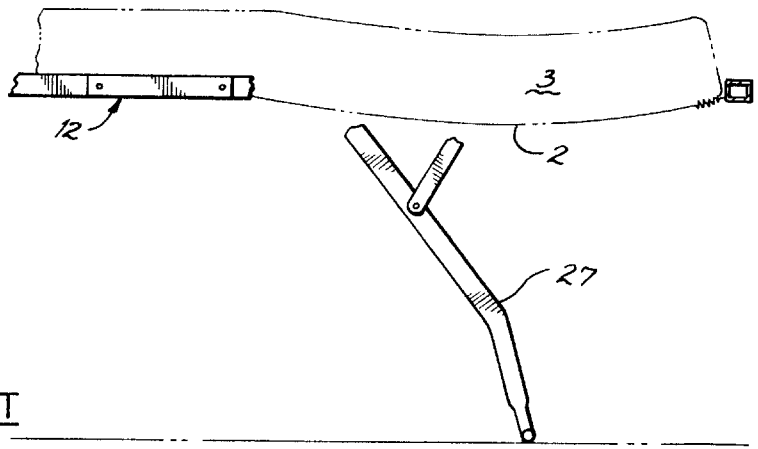
FIG. 3 PRIOR ART
FIG. 3 is a fragmented view of a mattress supported on a conventional deck to illustrate hammocking.

FIG. 3 shows a conventional mattress 3 supported on a conventional deck 2 of the prior art to illustrate the problem of "hammocking". Hammocking results from the fact that the deck 2 has insufficient strength to resist the weight of the mattress and an occupant (not shown) resting, sitting or reclining atop the mattress.

Figure 4:
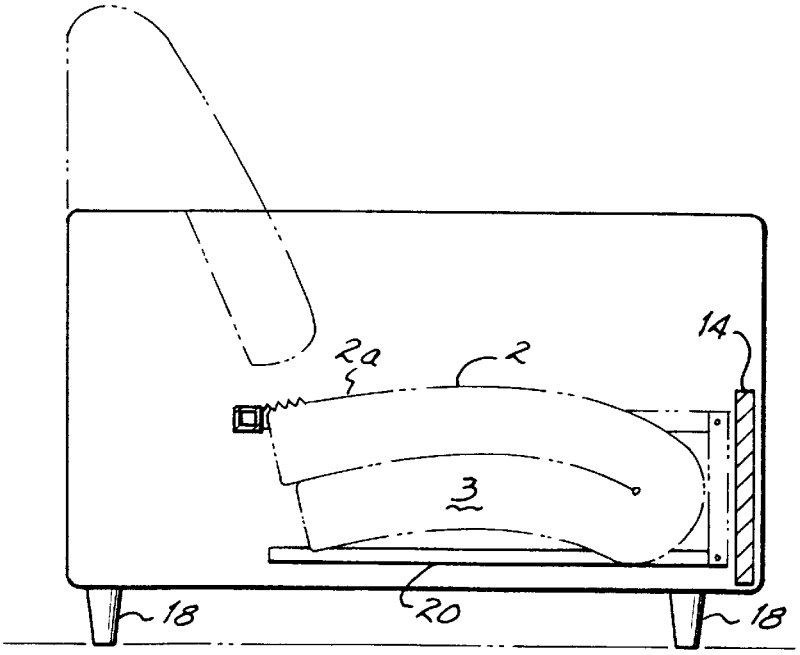
FIG. 4 PRIOR ART
FIG. 4 is a view generally similar to FIG. 2, but of a conventional sofa and deck to illustrate "crowning"

FIG. 4 discloses the conventional deck 2 as shown in FIG. 3, but with the sofa bed in the folded or sofa position. Due to the inadequate strength of the deck 2, the mattress 3 bulges upwardly to form a crown with a convex plane or surface 2*a*. The sofa bed cushions do not lay flat on such an uneven or crowned surface. This provides both an unsightly appearance and uncomfortable seat.

These problems are solved by the unique deck of this invention which may be incorporated into any suitable perimeter frame. The deck is arranged in the sofa bed such that when the sofa bed is in the bed position, the deck will not yield in a downward direction under the weight of the mattress and/or the occupant of the mattress, but provides a firm, flat, and generally planar support surface. However, when the deck is moved into the sofa position and the portion of the deck at the foot end of the mattress is folded into the overlying position represented by 12*a* in FIG. 2, the portion of the deck associated therewith will yield downwardly under the weight of the occupant of the sofa so as to provide a soft and comfortable seat. However, this portion of the deck will not be movable upwardly into a crowned or convex position under expansive forces of the mattress, but will remain in a generally horizontal position as shown in FIG. 2. This not only provides a comfortable seating surface but also allows the sofa cushions to lie flat on the deck rather than "smile".

In such a position, which is also shown in FIG. 2, the upper top layer 12*a* of the deck shown in FIG. 2 will be free to yield downwardly to provide a soft seat for one sitting, resting, or reclining thereon while the lower layer of the deck will be nonyielding to provide a substantially rigid planar support.

The deck support of this invention may also be employed internally to form a support in a box spring. It may also be made without a foldable frame, that is, for a mattress or seat that does not fold as disclosed above, or may be useful as is apparent by one of ordinary skill in the art.

Figure 6:
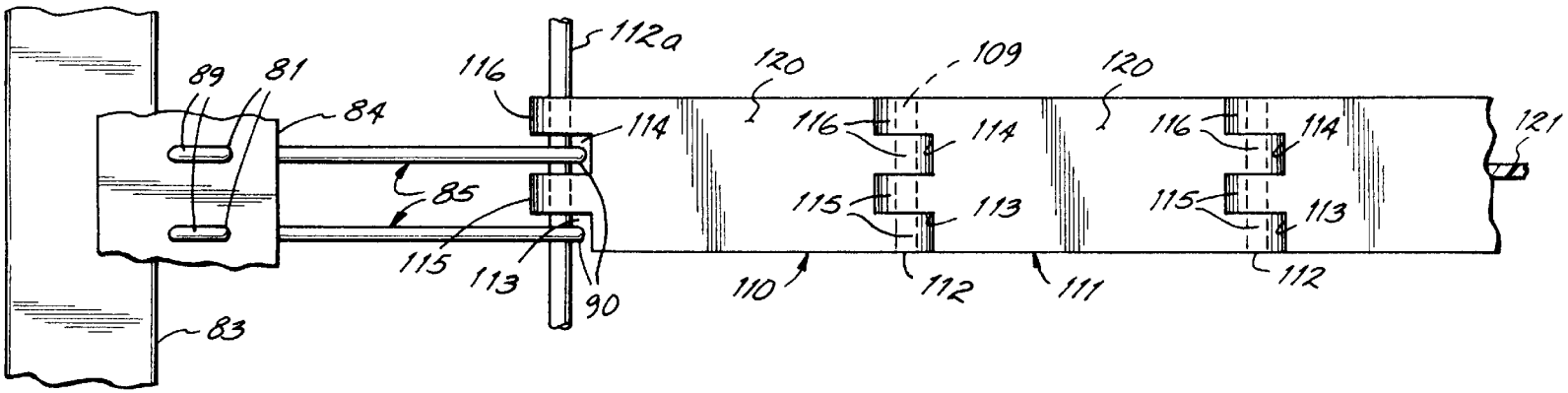
FIG. 6 is a top plan view of the deck shown in FIG. 5.
Figure 5:
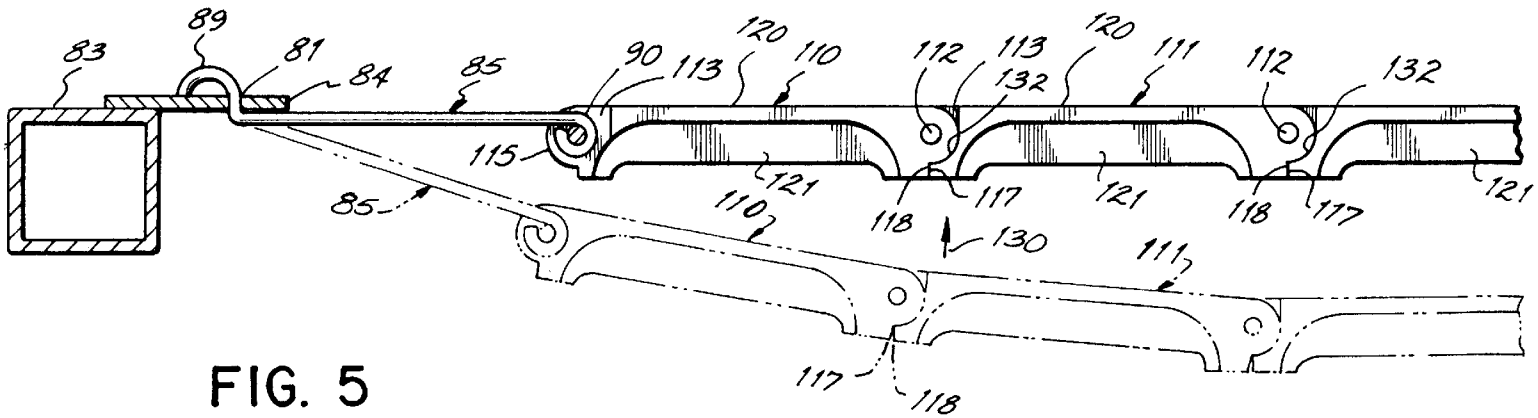
FIG. 5 is a partial cross-sectional view of a preferred embodiment of the deck.

Referring now to FIGS. 5 and 6, there is shown a preferred form of the invention wherein the support members 110 and 111 are linked together by pivot pins 112 in the opposite ends thereof which have recessed portions 113, 114 for accommodating the adjacent projecting end portion 115 and 116 of the neighboring support member. In this embodiment, the projecting end portions 115 and 116 are formed as a hinge barrel for receiving pivot pins 112 for pivotally linking the support members together. Apertures 109 extend through the end portions 115, 116 to receive the pivot pins 112 therethrough.

Pins 112*a* are provided for receiving links 85 which connect to a frame 83 of the sofa bed via a mounting bracket plate 84. Links 85 are received in the bracket 84 on the frame 83. The bracket 84 has a series of apertures 81 provided at predetermined locations. Specific apertures 81 are offset from each other to control the tension in the support members to provide uniform tension across the deck. Links 85 have their opposite ends formed with hook portions 89, 90. The hook portion 89 is received in an aperture of the bracket 84; whereas hook portion 90 is engaged about the pivot pin 112*a*.

Referring to FIG. 5, the recessed end portions 113 and 114 terminate at a stop surface 117 which is engageable with a projecting stop surface 118 formed on the adjacent end portions 115, 116 in order to limit the relative pivotal movement between the support members 110, 111 about pivot pin 112 in one angular direction when subjected to forces represented by the arrow 130 in FIG. 5. The support members 110, 111 however are free to pivot relative to each other in the opposite angular direction as illustrated by the phantom lines in FIG. 5.

In one preferred embodiment of the invention, the cross-section of the recessed portions 113, 114 is arcuate as indicated at 132 to complement and provide a seat for the arcuate surface of the mating end portion 115, 116 of the adjacent support member. Moreover it is E preferred that the support members 110, 111 be molded as an integral piece from a suitable plastic, such as polypropylene or the like. It is further preferred that the support members have a generally flat elongated rectangular surface on one side 120 which will receive a seat cushion when the deck is folded in the sofa mode when in use in a bed as shown in FIG. 5. The underside of each support member is provided with an integral reinforcing rib 121 extending longitudinally along the axis from end to end as best shown in FIG. 6. In the sofa configuration, the support members provide a substantially continuous planar surface as a result of the similarly oriented planar surfaces 120 which will be presented to the cushions of the associated sofa bed. However, the support members will yield downwardly to provide comfort but are resistant to yielding upwardly to prevent crowning.

Figure 7:
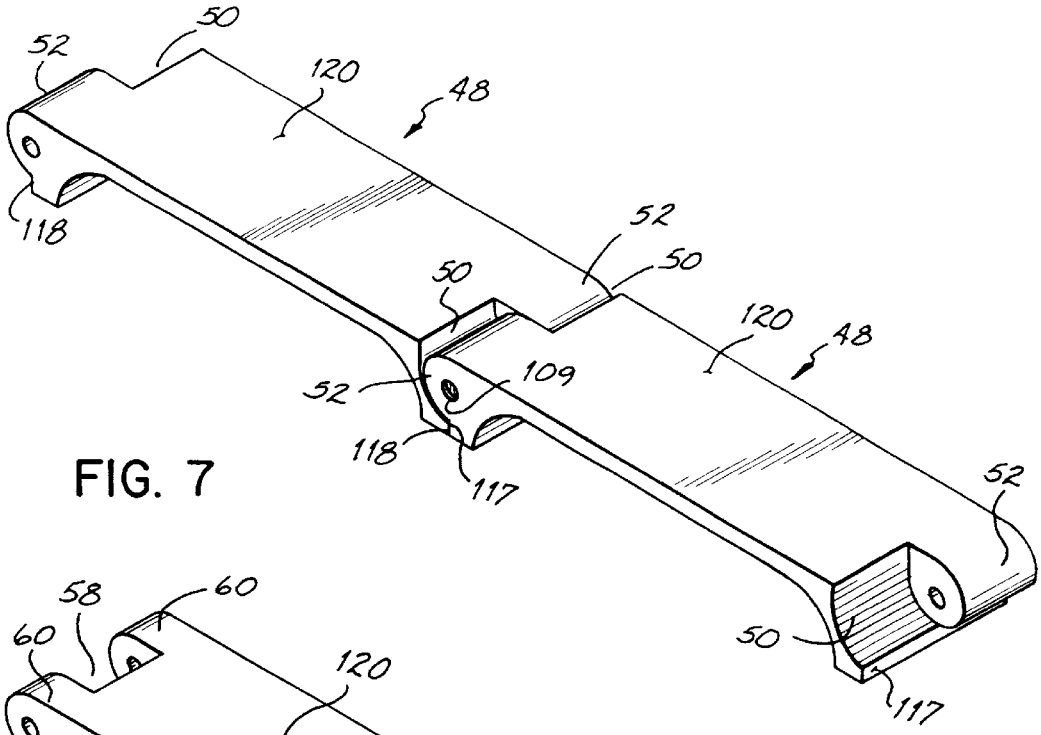
FIG. 7 is a perspective view of an alternative embodiment of links for use in the deck of this invention.

In a modification of the embodiment shown in FIGS. 5 and 6, the opposite ends of support members 48 are not bifurcated as shown in FIG. 6 but instead have a single recess 50 and a single projection 52 on each end which mate with a similarly configured support member having the projection 52 and recess 50 on an adjacent end as shown in FIG. 7.

Figure 8:
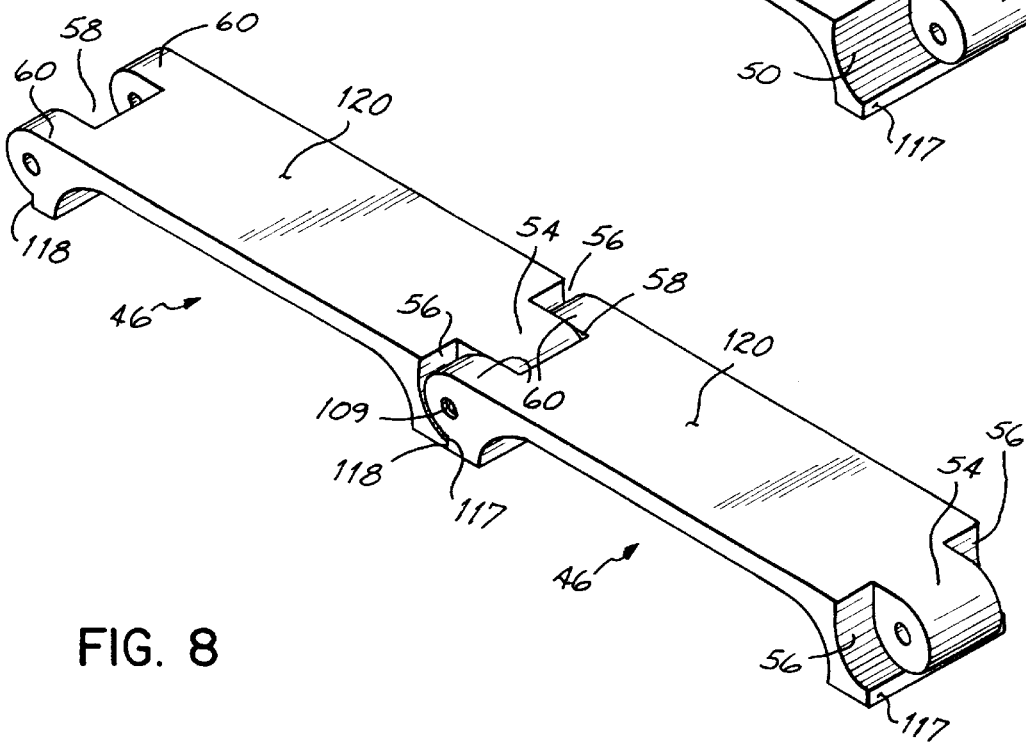
FIG. 8 is a perspective view of another alternative embodiment of links according to this invention.

A third preferred embodiment of the invention is shown in FIG. 8 in which a support member 46 has a single projection 54 centered on one end thereof and flanked on each side by a recess 56. The opposite end of the support member has a single center recess 58 which is flanked by a pair of projections 60. When linked together as shown in FIG. 8, the single projection 54 is coupled to the adjacent support member between the pair of projections 60 in the recess 58 to provide the support and bending capabilities required of the invention.

It will thus be seen that in all of the different embodiments described above, support members are pivotally interconnected to allow relative movement in one angular direction but stops are provided to prevent or limit movement in the opposite or counter direction.

From the above disclosure of the general principles of this invention and the preceding detailed description of preferred embodiments, those skilled in the art will readily comprehend the various modifications to which the this invention is susceptible. Therefore, I desire to be limited only by the scope of the following claims and equivalents thereof.

I claim:

1. A deck for seating or bedding, said deck being edge supported by a frame of a sofa sleeper movable between a folded sofa position and an unfolded bed position, said deck comprising a plurality of support members extending generally in the same direction to form a support, said support members having adjacent ends connected to each other for movement relative to each other, and at least one stop on each said member arranged such that upon movement of said members in one direction the stop will engage a stop surface on an adjacent support member to limit movement and upon movement of the members in a direction opposite said one direction the stop will be spaced from the stop surface on said adjacent support member to permit movement in said opposite direction, each end of each said support member having at least one recess and at least one projection for mating with a similar said recess and projection on said adjacent support member.

2. The deck defined in claim 1 wherein a pair of said stops are provided at opposite ends of said support members.

3. The deck defined in claim 1 wherein each said projection includes an aperture for a pivot pin to be inserted therein to pivotally couple adjacent support members.

4. The deck defined in claim 1 wherein the ends of each of the support members have a pair of spaced projections and a pair of spaced recesses to receive a mating similarly configured end of said adjacent support member.

5. The deck defined in claim 1 wherein said support members have planar surfaces on one side thereof.

6. The deck defined in claim 1 wherein said support members are made from molded plastic.

7. The deck defined in claim 1 wherein said support members are made from extruded plastic.

8. The deck defined in claim 1 including a border frame having a series of apertures spaced along the frame and a plurality of links received in said apertures and connected to the support members for suspending the support members from the frame.

9. The deck defined in claim 1 wherein each said support member is integrally formed and has a generally planar surface on one side thereof.

10. The deck defined in claim 1 wherein each said support member has a pair of projections spaced apart by a recess on a first end and a projection positioned between a pair of recesses on a second end such that adjacent support members mate with said pair of projections of said first end being positioned within said pair of recesses of said second of an adjacent support member.

11. The deck defined in claim 1 further comprising a reinforcing rib extending longitudinally on said support member.

12. In a sofa bed having a frame movable between a folded position for sofa use and an unfolded position for bed use, said frame including a deck for supporting bedding, said deck being edge supported by said frame and having a portion adapted to overly bedding when the frame is in the folded position and to underlay the bedding when the frame is in the unfolded position, said deck portion yielding in a downward direction and relatively resistant to yielding in an upward direction when the frame is in the folded position, said deck portion including a plurality of support members pivotally connected to each other and having a stop for limiting movement of said members in said upward direction, each said stop including a stop surface which is spaced from said adjacent support member when said deck is yielding in said downward direction and is engaged by said adjacent support member when said deck is relatively resistant to yielding in said upward direction, each said support member having at least one projection and at least one recess on opposing ends thereof to facilitate coupling to adjacent support members.

13. The sofa bed defined in claim 12 wherein said stop means are located at opposite end portions of said members.

14. The sofa bed defined in claim 12 wherein said support members are coupled with adjacent support members with a pivot pin extending through an aperture in the projection of said support members.

15. The sofa bed defined in claim 12 wherein said deck includes support members connected to each other at joints and wherein there is included means for preventing movement of the support members at the joints when forces are applied to the joints in said upward direction when the frame is in the folded position.

* * * * *